US007108604B2

(12) United States Patent
Kameta et al.

(10) Patent No.: US 7,108,604 B2
(45) Date of Patent: Sep. 19, 2006

(54) GAME MACHINE, METHOD OF CONTROLLING OPERATION OF THE GAME MACHINE, AND COMPUTER READABLE MEDIUM HAVING RECORDED THEREON OPERATION CONTROL PROGRAM FOR CONTROLLING THE GAME MACHINE

(75) Inventors: Takeshi Kameta, Tokyo (JP); Naomitsu Tsugiiwa, Tokyo (JP)

(73) Assignee: Konami Corporation, Tokyo (JP)

( * ) Notice: Subject to any disclaimer, the term of this patent is extended or adjusted under 35 U.S.C. 154(b) by 748 days.

(21) Appl. No.: 09/880,833

(22) Filed: Jun. 15, 2001

(65) Prior Publication Data

US 2002/0013168 A1 Jan. 31, 2002

(30) Foreign Application Priority Data

Jul. 31, 2000 (JP) ..... 2000-230124

(51) Int. Cl.
*A63F 9/24* (2006.01)
*A63F 13/00* (2006.01)

(52) U.S. Cl. ..... 463/31; 463/1

(58) Field of Classification Search ..... 463/1, 463/2, 3, 4, 6, 7, 8, 43, 30, 31
See application file for complete search history.

(56) References Cited

U.S. PATENT DOCUMENTS 5,163,688 A 11/1992 Simms
5,662,332 A 9/1997 Garfield
5,954,332 A 9/1999 Mero et al.
6,200,216 B1 * 3/2001 Peppel ..... 463/1
6,283,854 B1 * 9/2001 Niwa ..... 463/7
6,468,162 B1 * 10/2002 Nakamura ..... 463/43
6,488,582 B1 * 12/2002 Suzuki ..... 463/31
6,612,501 B1 * 9/2003 Woll et al. ..... 235/494
6,623,010 B1 * 9/2003 Holland, Jr. ..... 273/292
6,729,960 B1 * 5/2004 Matsuno ..... 463/30

FOREIGN PATENT DOCUMENTS

EP 0 988 875 A2 3/2000
JP 2000-157744 A 6/2000

* cited by examiner

*Primary Examiner*—Carl S. Miller
(74) *Attorney, Agent, or Firm*—Sughrue Mion, PLLC

(57) ABSTRACT

A CPU (30) sets a plurality of stages in which a plurality of opposing characters which are to become opponents in a battle become able to appear, and causes a player to advance to a next stage after having won over respective opposing characters in a certain stage, thereby increasing the number of cards available in a battle.

17 Claims, 15 Drawing Sheets

| CARD NAME | | | a | c | d | e | f | ····· | b |
|---|---|---|---|---|---|---|---|---|---|
| FIELD | NORMAL | OFFENCE | 400 | 2400 | 920 | 2000 | 1810 | ····· | 1300 |
| | | DEFENCE | 300 | 2000 | 1830 | 1530 | 1530 | ····· | 1500 |
| | FOREST | OFFENCE | 1760 | 2640 | 820 | 1280 | 2000 | ····· | 1690 |
| | | DEFENCE | 1320 | 2200 | 1930 | 1730 | 1530 | ····· | 2015 |
| | WILDERNESS | OFFENCE | 2080 | 2400 | 828 | 1242 | 1800 | ····· | 1300 |
| | | DEFENCE | 1560 | 2000 | 1737 | 1737 | 1377 | ····· | 1560 |
| | MOUNTAIN | OFFENCE | 1440 | 3120 | 800 | 1242 | 1800 | ····· | 1300 |
| | | DEFENCE | 1080 | 2600 | 1737 | 1727 | 1377 | ····· | 1550 |
| | GREEN FIELD | OFFENCE | 1760 | 2840 | 825 | 1242 | 1800 | ····· | 1430 |
| | | DEFENCE | 1320 | 2200 | 1737 | 1737 | 1377 | ····· | 1705 |
| | OCEAN | OFFENCE | 1120 | 2640 | 828 | 1242 | 1800 | ····· | 810 |
| | | DEFENCE | 840 | 2200 | 1737 | 1737 | 1377 | ····· | 1085 |
| | DARKNESS | OFFENCE | 1400 | 2400 | 1200 | 1800 | 2500 | ····· | 1760 |
| | | DEFENCE | 1200 | 2000 | 2500 | 2500 | 2000 | ····· | 1550 |
| CARD IMAGE DATA | | | A | C | D | E | F | ····· | B |

FIG. 17

| CASE | DETAILS OF PROCESSING |
|---|---|
| "OFFENSE" VS. "DEFENCE" | · SUBTRACT LIFE POINTS EQUAL TO DIFFERENCE IN OFFENSE POWER INDICES OF BOTH CARDS FROM LOSER'S LIFE POINT TOTAL, AND CAUSE LOSER'S CARD TO DISAPPEAR FROM LOSER'S SCREEN |
| "OFFENSE" VS. "DEFENCE," "OFFENSE" HAS WON A GAME | · CAUSE LOSER'S CARD TO DISAPPEAR FROM LOSER'S SCREEN |
| "OFFENSE" VS. "DEFENCE," "DEFENCE" HAS WON A GAME | · SUBTRACT LIFE POINTS EQUAL TO A DIFFERENCE BETWEEN POWER INDICES OF BOTH CARDS |
| "OFFENSE" VS. "NO CARD IN FIELD" | · SUBTRACT LIFE POINTS EQUAL TO OFFENSE POWER INDEX FROM LIFE POINT TOTAL OF THE PLAYER WHO HAS LAID NO CARD IN FIELD |

FIG. 18

| STAGE | OPPOSING CHARACTERS |
|---|---|
| FIRST STAGE | DUELIST 1, DUELIST 2, DUELIST 3, DUELIST 4 AND DUELIST 5 |
| SECOND STAGE | DUELIST A, DUELIST B, DUELIST C, DUELIST D AND DUELIST E |
| THIRD STAGE | DUELIST (1), DUELIST (2), DUELIST (3), DUELIST (4) AND DUELIST (5) |
| FOURTH STAGE | SHIRDY, ISHIZU, MARK AND SIMON |

FIG. 22

230

| DATE OF OCCURRENCE OF EVENT | ITEMS | DETAILS OF EVENTS | OPPOSING CHARACTERS | FIELD |
|---|---|---|---|---|
| SECOND MONDAY ON JANUARY | COMING-OF-AGE DAY | YOU CAN GET A CARD IF YOU HAVE WON A GAME | KUJYAKUMAI | MOUNTAIN |
| SECOND MONDAY ON OCTOBER | HEALTH-SPORTS DAY | YOU CAN GET A CARD IF YOU HAVE WON A GAME | JYONOUCHI | MOUNTAIN |
| | VERNAL EQUINOX DAY | YOU CAN GET A CARD IF YOU HAVE WON A GAME | EVERYONE | PLAIN |
| | AUTUMNAL EQUINOX DAY | YOU CAN GET A CARD IF YOU HAVE WON A GAME | EVERYONE | PLAIN |
| JANUARY 1ST | NEW YEAR'S DAY | YOU CAN GET A CARD IF YOU HAVE WON A GAME | YAMI-YUGI | DARKNESS |
| FEBRUARY 11TH | NATIONAL FOUNDATION DAY | YOU CAN GET A CARD IF YOU HAVE WON A GAME | DINOSAUR RYUZAKI | WILDER-NESS |
| APRIL 29TH | GREEN DAY | YOU CAN GET A CARD IF YOU HAVE WON A GAME | INSECTOR HAGA | FOREST |
| MAY 3RD | CONSTITUTION DAY | YOU CAN GET A CARD IF YOU HAVE WON A GAME | BAKURA RYO | DARKNESS |
| MAY 4TH | NATIONAL HOLIDAY | YOU CAN GET A CARD IF YOU HAVE WON A GAME | HONDA HIROTO | WILDER-NESS |
| MAY 5TH | CHILDREN'S DAY | YOU CAN GET A CARD IF YOU HAVE WON A GAME | MUTO YUGI | NORMAL |
| JULY 20TH | OCEAN DAY | YOU CAN GET A CARD IF YOU HAVE WON A GAME | KAJIKI RYOTA | OCEAN |
| SEPTEMBER 15TH | RESPECT-FOR-THE-AGED DAY | YOU CAN GET A CARD IF YOU HAVE WON A GAME | PANDORA | DARKNESS |
| NOVEMBER 3RD | CULTURE DAY | YOU CAN GET A CARD IF YOU HAVE WON A GAME | ESPER ROBA | NORMAL |
| NOVEMBER 23RD | LABOR THNAKSGIVINGS DAY | YOU CAN GET A CARD IF YOU HAVE WON A GAME | SHINZAKI KYOKO | FOREST |
| DECEMBER 23RD | THE EMPEROR'S BIRTHDAY | YOU CAN GET A CARD IF YOU HAVE WON A GAME | SETO | DARKNESS |
| MARCH 21ST | FOUNDATION DAY | YOU CAN GET A CARD IF YOU HAVE WON A GAME | SIMON MOOLAN | NORMAL |
| OCTOBER 31ST | HALLOWEEN | YOU CAN GET A CARD IF YOU HAVE WON A GAME | RARE CARD HUNTER | DARKNESS |
| DECEMBER 24TH | CHRISTMAS EVE | YOU CAN GET ONE BACK-PLUS IF YOU HAVE WON A GAME | EVERYONE | NORMAL |
| FEBRUARY 14TH | VALENTINE'S DAY | YOU CAN GET A CARD IF YOU HAVE WON A GAME | KYOKO, MAI | NORMAL |
| MARCH 14TH | WHITE DAY | YOU CAN GET A CARD IF YOU HAVE WON A GAME | JYONOUNCHI, YUGI, BAKURA, HONDA | |

GAME MACHINE, METHOD OF CONTROLLING OPERATION OF THE GAME MACHINE, AND COMPUTER READABLE MEDIUM HAVING RECORDED THEREON OPERATION CONTROL PROGRAM FOR CONTROLLING THE GAME MACHINE

BACKGROUND OF THE INVENTION

1. Field of the Invention

The present invention relates to an improvement in a game machine which enables a player and an opponent to play a battle by way of laying down their cards on a game screen. Also, the present invention relates to an improvement in a method of controlling the operation of the game machine. Further, the present invention relates to an improvement in a recording medium, such as a computer readable medium, having recorded thereon an operation control program for controlling the game machine.

The present application is based on Japanese Patent Application No. 2000-230124, which is incorporated herein by reference.

2. Description of the Related Art

There has been in vogue a game in which a player and an opponent play a battle by way of laying their cards in a predetermined area on a display section of a game machine through actuation of operation buttons. In a game machine of the type, a plurality of cards capable of being used for a battle are stored in a memory location called "baggage." A predetermined number of cards chosen from the cards are stored in a memory location called a "deck." Card information is read directly from the deck, and a card game is effected.

In a game of the type, entertainment value is increased as the number of cards capable of being stored in a deck are stored in the baggage is increased. To this end, it is considered that the number of cards usable in a battle is increased, by way of purchasing several from among an abundance of available recording mediums having card information recorded thereon.

Even when the number of cards usable in a battle is increased in such a way, no additional entertainment value is found in the manner of increasing the number of cards. Therefore, there has existed a desire for increasing the number of cards usable in a battle while a player is enjoying a game.

SUMMARY OF THE INVENTION

The present invention has been conceived to solve a drawback of the game machine of the related art. Thus, the present invention is aimed at providing a game machine which enables a player to increase the number of cards usable in a battle while enjoying a game. Further, the present invention is aimed at providing a method of controlling the operation of the game machine, and a recording medium, such as a computer readable medium, having recorded thereon an operation control program for controlling the game machine.

To achieve the object, according to a first aspect of the present invention, there is provided a game machine which enables a player and an opponent to play a battle by laying down their cards in a game screen. The game machine comprises a control device which increases the number of cards available in a battle when the player continues winning.

In accordance with the first aspect of the present invention, the player can increase the number of cards available in a battle while enjoying a game.

According to a second aspect of the present invention, the control device may set a plurality of stages in which a plurality of opposing characters which are opponents in a battle are able to appear. In this case, the control device may cause the player to advance to a next stage after having won over respective opposing characters in a certain stage. Also, in this case, the control device may increase the number of cards available in a battle.

According to a third aspect of the present invention, the control device may set a plurality of stages in which a plurality of opposing characters which are opponents in a battle are able to appear, and increase the number of cards available in a battle when the player has won over the opposing characters at least a predetermined number of times in a certain stage.

According to a fourth aspect of the present invention, it is preferable that the control device enables loading of, on a per-unit-card-information-set basis, a plurality of card information sets pertaining to a plurality of cards recorded on a computer readable medium, thereby enabling the player to increase the number of cards available in a battle.

According to a fifth aspect of the present invention, it is preferable that the control device sets a read enable flag for a card information set for which loading has been permitted.

According to a sixth aspect of the present invention, it is preferable that the plurality of card information sets are set so as to differ from each other because the entertainment value of the game is increased correspondingly.

According to a seventh aspect of the present invention, it is preferable that the computer readable medium includes an external computer readable medium removably attached to the game machine, and a setting region for the read enable flag is formed on the external computer readable medium. Accordingly, formation of a read enable flag setting region is facilitated.

According to an eighth aspect of the present invention, the control device may update time information pertaining to the world of a game every time the player plays a battle with an opposing character, and effect contents of an event when requirements for occurrence of an event are satisfied if the updated time corresponds to a predetermined date and time at which an event is to arise. Thus, the entertainment value of a game can be enhanced much greater.

According to a ninth aspect of the present invention, the control device causes the player to acquire a new card available in a battle when the player has won over an opposing character, when the player's winning over an opposing character is defined as a requirement for occurrence of an event. Thus, the entertainment value of a game can be enhanced much greater.

Furthermore, to achieve the object, according to a tenth aspect of the present invention, there is provided a method of controlling operation of a game machine which enables a player and an opponent to play a battle by laying down their cards. The method comprises the steps of:

setting a plurality of stages in which a plurality of opposing characters which are opponents in a battle are able to appear; and causing the player to proceed to the next stage when having won over the opposing characters in a certain stage, thereby increasing the number of cards available in a battle.

In accordance with the tenth aspect of the present invention, as the player advances to higher stages, the number of cards available in a battle is increased. Consequently, the player can increase the number of cards available in a battle while enjoying a game.

Furthermore, to achieve the object, according to an eleventh aspect of the present invention, there is provided a method of controlling operation of a game machine which enables a player and an opponent to play a battle by laying down their cards. The method comprises the steps of:

setting a plurality of stages in which a plurality of opposing characters which are opponents in a battle are able to appear; and increasing the number of cards available in a battle when the player has won over the opposing characters at least a predetermined number of times in a certain stage.

In accordance with the eleventh aspect of the present invention, if the player has won over opposing characters in a certain stage a predetermined number of times or more, the number of cards available in a battle is increased. Hence, the player can increase the number of his cards available in a battle while enjoying a game.

According to a twelfth aspect of the present invention, the method according to any one of the tenth and eleventh aspects may further comprise the steps of:

updating time information pertaining to the world of a game every time the player plays a battle with an opposing character; and effecting details of an event when requirements for occurrence of an event have been satisfied if the updated date and time corresponds to a predetermined date and time at which a certain event is to arise.

In accordance with the twelfth aspect of the present invention, the entertainment value of a game is increased to a much greater extent.

Furthermore, to achieve the object, according to a thirteenth aspect of the present invention, there is provided a computer readable medium having recorded thereon an operation control program for controlling operation of a game machine which enables a player and an opponent to play a battle by laying down their cards. The operation control program comprises a processing routine for increasing the number of cards available in a battle when the player continues winning.

In accordance with the thirteenth aspect of the present invention, when a computer executes an operation control program, there is performed processing of increasing the number of player's cards available in a battle as the player advances to next stages. Hence, the player can increase the number of cards available in a battle while enjoying a game.

According to a fourteenth aspect of the present invention, the processing routine of the thirteenth aspect may include:

setting a plurality of stages in which a plurality of opposing characters which are opponents in a battle are able to appear, and causing the player to proceed to the next stage when having won over the opposing characters in a certain stage, thereby increasing the number of cards available in a battle.

According to a fifteenth aspect of the present invention, the processing routine of the thirteenth aspect may include:

setting a plurality of stages in which a plurality of opposing characters which are opponents in a battle are able to appear, and increasing the number of cards available in a battle when the player has won over the opposing characters at least a predetermined number of times in a certain stage.

It should be noted that the aforementioned computer readable medium may include a recording medium which enables recording and reading of digital contents. More specifically, such the computer readable medium includes, for example, a semiconductor recording medium such as a ROM (i.e., Read Only Memory), a semiconductor IC (i.e., Integrated Circuit), etc., an optical recording medium such as a DVD-ROM (i.e., Digital Versatile Disk-Read Only Memory), a CD-ROM (i.e., Compact Disc-Read Only Memory), etc., a magnetic recording medium such as a flexible disk etc., and a magneto-optical medium such as an MO (i.e., Magneto Optical Disk) etc.

BRIEF DESCRIPTION OF THE DRAWINGS

The above and other objects and advantages of the present invention will become more apparent by describing in detail preferred embodiments thereof with reference to the accompanying drawings, wherein:

FIG. 17 is a descriptive view for explaining a winning/losing determination processing;

FIG. 18 is a descriptive view showing an embodiment according to the present invention;

FIG. 22 is a descriptive view of an event table 230; and

DETAILED DESCRIPTION OF THE PREFERRED EMBODIMENTS

Preferred embodiments of the present invention now will be described with reference to the accompanying drawings. First, the "configuration" of a game machine according to embodiments of a present invention will be described. Next, "general operations and contents" of a game of this type will be described. Finally, the "principal feature" of the present invention will be described for facilitating comprehension of the present invention.

1. Configuration

Figure 1:
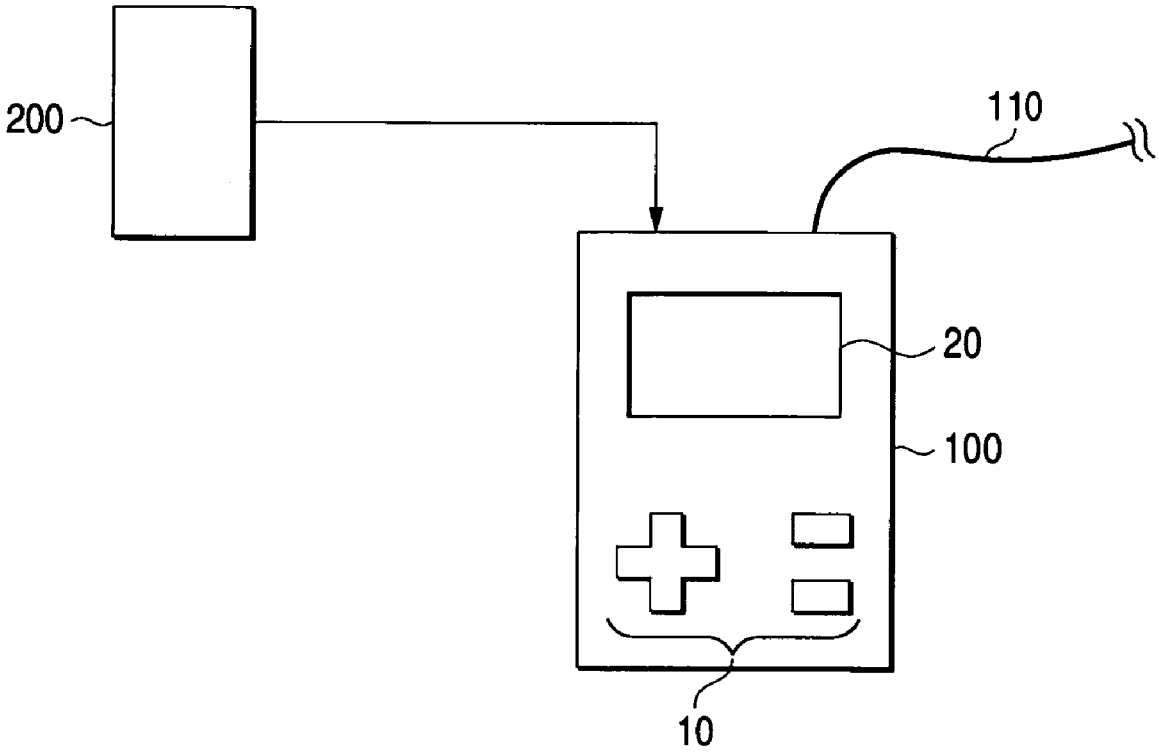
FIG. 1 is an external view of a game machine of an embodiment according to the present invention.

FIG. 1 is an external view of a game machine 100 according to embodiments of the present invention. Control buttons 10 used for performing various operations and a display section 20 on which a game screen is to be displayed are provided on the front surface of the game machine 100. The game machine 100 is constructed such that a cassette 200 serving as an external recording medium having recorded thereon an operation control program for executing a card game is removably attached to the game machine 100. The game machine 100 enables execution of a card game with a game machine (not shown) of the same type by way of a communications cable 110 while required information is exchanged therebetween.

As a matter of course, a player can play a battle against the game machine 100 (CPU) (i.e., a player can enjoy playing a card game alone). Thus, a player can select either a battle against a human opponent or a battle against the game machine 100. Although FIG. 1 shows a case where a cable method using the communications cable 110 is employed, exchange of desired information may be established in any form, such as ultrasonic vibration, infrared rays, or radio communication such as that via a radio wave.

Figure 2:
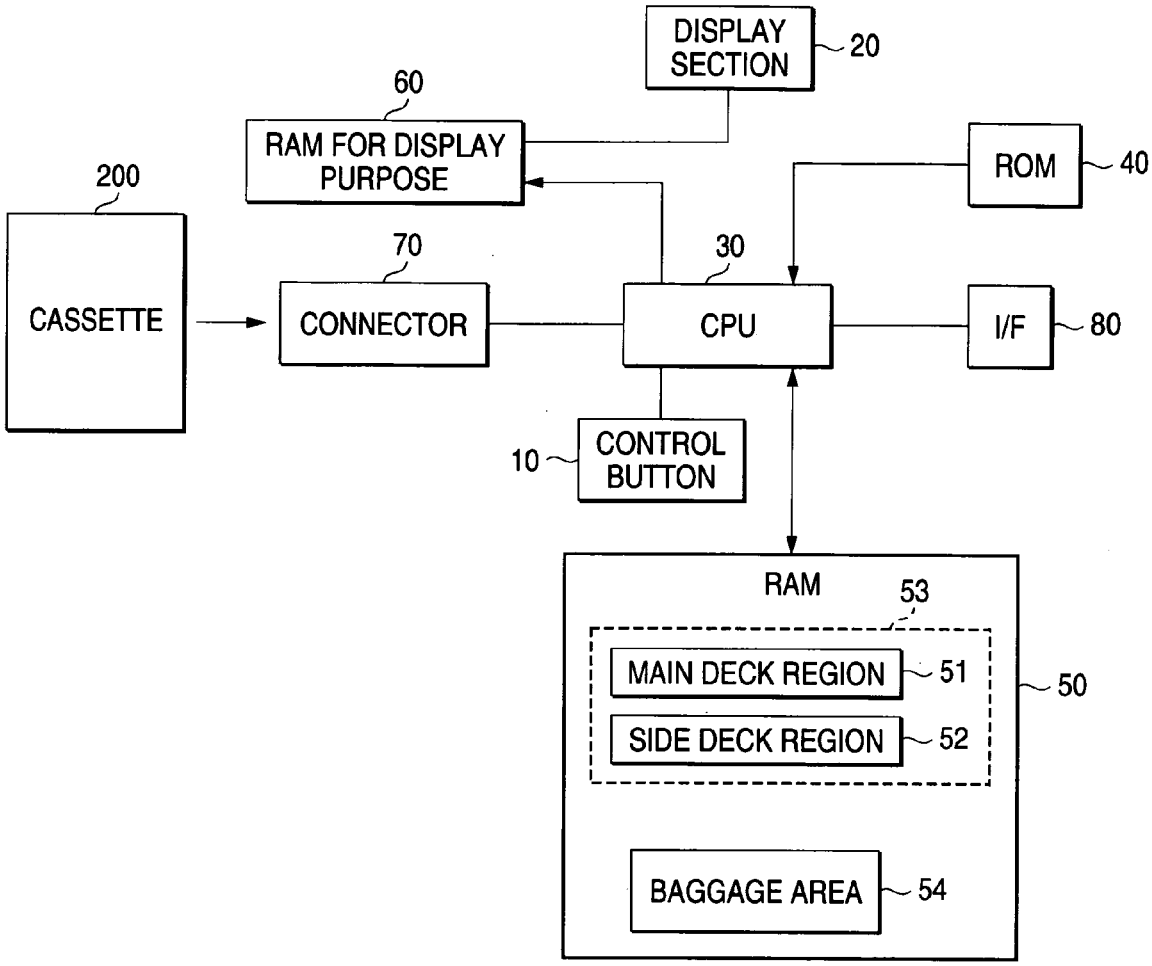
FIG. 2 is a block diagram of the game machine of the embodiment according to the present invention.

FIG. 2 is a block diagram showing the game machine 100 and the cassette 200 removably attached to the game machine 100. The game machine 100 comprises control buttons 10 used for performing various operations; a display section 20 embodied by a liquid-crystal display; a CPU 30 which effects a primary control operation such as execution of a card game; ROM 40 for recording basic software used for activating the CPU 30; RAM (i.e., Random Access Memory) 50 acting as a work area; RAM 60 for display purpose for storing display data to be displayed on the display section 20; a connector 70 for establishing electrical connection with the cassette 200; and an interface (I/F) 80 for establishing connection with the communications cable 110. A deck area 53 and a baggage area 54 are formed in the RAM 50. Further, the deck area 53 has a main deck region 51 capable of storing card information pertaining to forty or more cards, and a side deck region 52 capable of storing card information pertaining to, e.g., fifteen cards.

Figure 3:
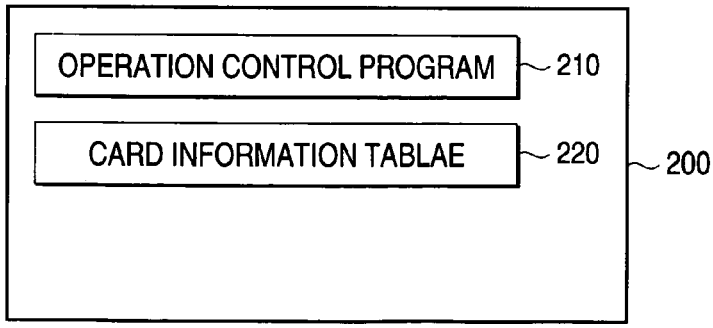
FIG. 3 is a descriptive view showing contents of data recorded in a cassette 200.
Figure 4:
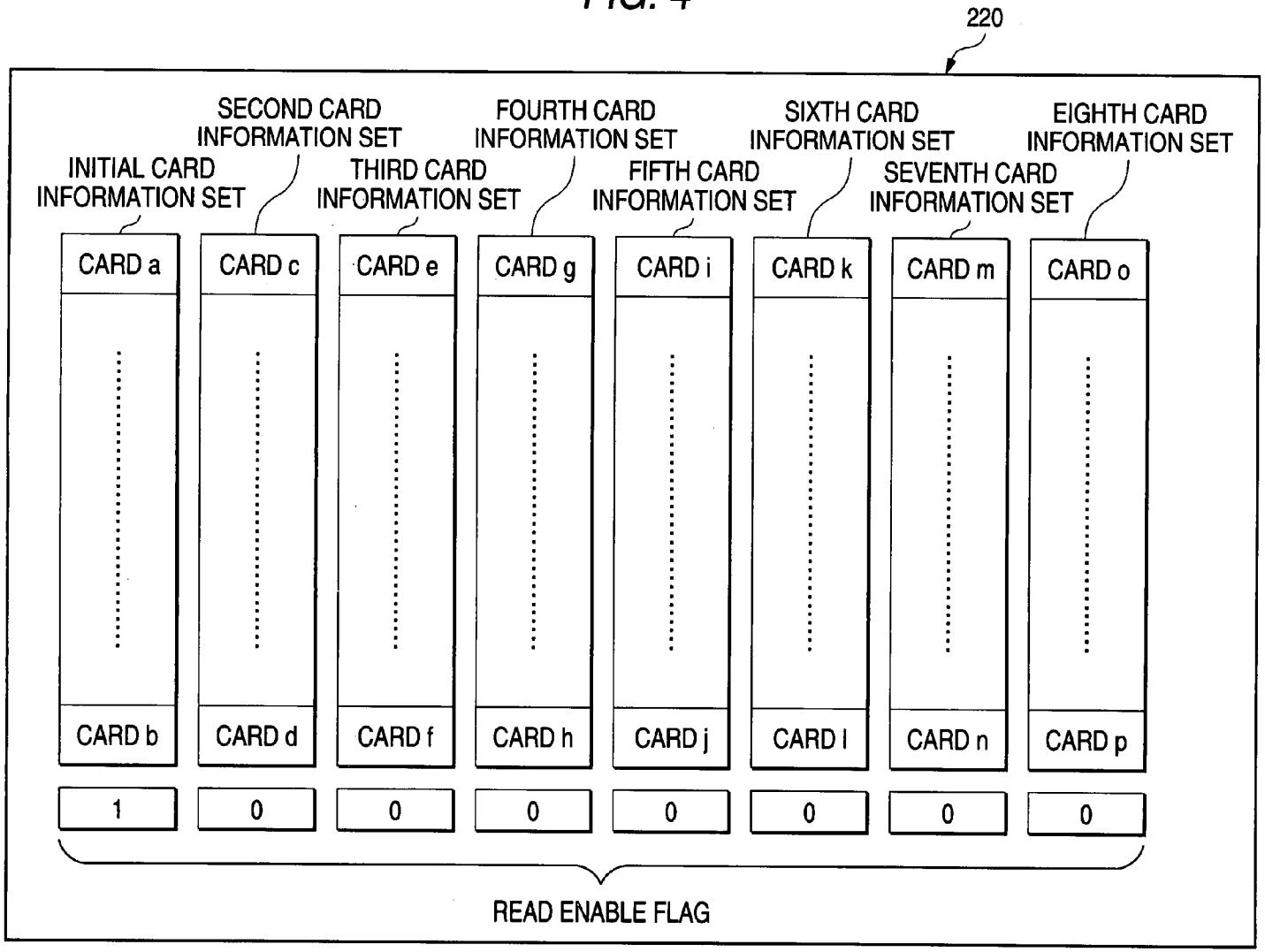
FIG. 4 is a descriptive view of the card information table 220.

As shown in FIG. 3, the cassette 200 has recorded thereon an operation control program 210 for effecting a card game, and a card information table 220 for storing card information items concerning cards. As shown in FIG. 4, the card information table 220 stores eight types of card information sets; that is, a set of initial card information items (called "initial card information set") and second through eighth sets of card information items (called "second through eighth card information sets"), and read enable flags assigned to respective card information sets.

Figures 5, 6:
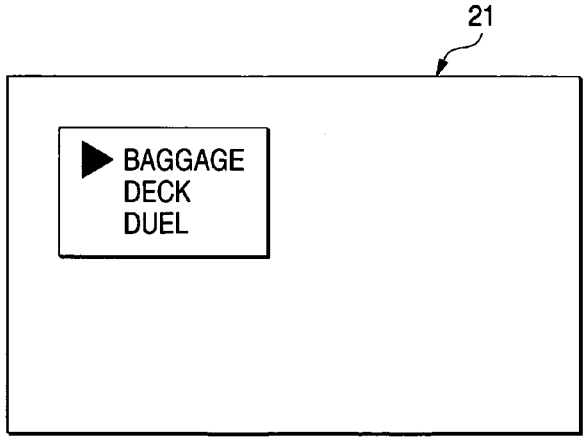
FIG. 5 is a descriptive view of sets of card information items.
FIG. 6 is a descriptive view showing an example of a display screen appearing in a display area 21 on a display section 20.

As shown in FIG. 5, card names, fields, and card image data are stored in one card information set so as to be associated with each other. The illustrated example shows an initial card information set, in which information pertaining to cards "a" through "b" (i.e., card information items) are stored. Here, the term "Field" means a game environment set in a card game. In this example, there are set seven types of fields; that is, "Normal," "Forest," "Wilderness," "Mountains," "Green Field," "Ocean," and "Darkness." Further, an "Offense" power index and a "Defense" power index are numerically set for each of the fields. An "Offense" power index is called an offense power index, and a "Defense" power index is called a defense power index. Details of a game using these power indices will be described later.

As can be seen from the card information sets, the offense power index of a certain card usually differs from the defense power index of the same card even in an identical field. Further, the power indices of a certain card may change from field to field. In connection with image data, a character set for each card name appears. In this card game, the card information sets are used when a player has selected either "ATTACK" or "DEFEND" in any one of the seven types of fields.

When a read enable flag shown in FIG. 4 assumes a value of "1," the CPU 30 loads a corresponding card information set into the baggage area 54 and reads desired card information items from the card information set and loads the same into the main deck region 51 and the side deck region 52, thus constructing a deck. When the read enable flag assumes a value of "0," the CPU 30 is not allowed to load a corresponding card information set into the baggage area 54.

2. General Operations

When the cassette 200 is attached to the game machine 100, the CPU 30 is electrically connected to the connector 70, and a player actuates the control button 10 to thereby instruct resetting or turning on of power, the CPU 30 operates in accordance with basic software recorded in the ROM 40, reads the operation control program 201 from the cassette 200, and de-archives the thus-loaded operation control program 201 in the RAM 30. Since a read enable flag assigned to the initial card information set assumes a value of "1," the CPU 30 reads a card name, image data, and a field (and a card number (not shown) as well) described in the initial card information set shown in FIG. 5 and stores the thus-read information items into the baggage area 54 of the RAM 51.

The CPU 30 executes a game through use of the operation control program 201 de-archived in the RAM 30 and the initial card information set stored in the baggage area 54. "Baggage" is selected by actuation of the control button 10 while a guide menu shown in FIG. 6 is displayed in the display area 21, to thereby move a solid triangular mark (YES is selected in step S700). In step S702 shown in FIG. 7, a card name, offense and defense power indices, and a card number, which are assigned to each card stored in the baggage area 54, are displayed in the display area 21 (not shown).

When "Baggage" is not selected (NO is selected in step S700), a determination is made in step S704 as to whether or not "Deck" has been selected by actuation of the control button 10. When "Deck" has not been selected (NO is selected in step S704), processing proceeds to step S708. In contrast, when "Deck" has been selected (YES is selected in step S704), in step S706 data sets pertaining to, e.g., 40 cards are read from the baggage area 54. The thus-read data sets are stored in the main deck region 51. Further, ten card information items may be read and stored in the side deck region 52. Alternatively, the CPU 30 may read data sets in accordance with an instruction entered by way of the control button 10 or the CPU 30 may automatically load card information.

Figure 8:
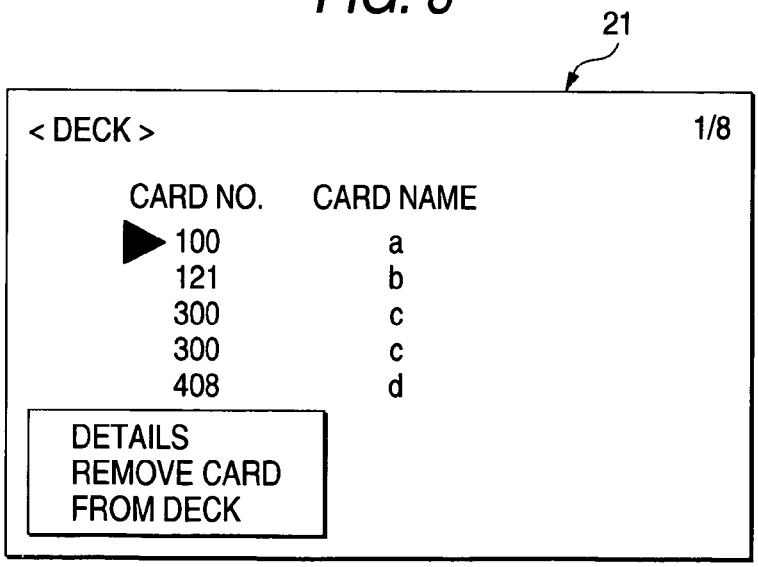
FIG. 8 is a descriptive view showing an example of a display screen appearing in a display area 21 on a display section 20.

Card information items stored in the deck area 53 are used for a card game. FIG. 8 shows a display screen appearing on the display area 21 immediately after a reading operation pertaining to step S706 has been performed. Card numbers and card names belonging to card information items stored in the main deck region 51 appear in the center of the display area 21. A guidance menu appears in a position below the card numbers and the card names. When "Details" is selected by actuation of the control button 10, the CPU 30 displays detailed data pertaining to a card specified by the solid triangular mark; that is, offense and defense power indices of a character provided in the card in respective fields.

When "Remove a card from the deck" is selected by actuation of the control button 10, the CPU 30 returns, to the baggage area 54, the card information item pertaining to the card specified by the solid triangular mark. "⅛" appearing at the upper right corner represents that the current screen is the first page of a total of 8 pages. The CPU 30 increments or decrements the page number by actuation of the control button 10, thereby sequentially providing, in the display area 21, five card numbers and their card names belonging to a currently-displayed page. Thus, the cards stored in the deck area 53 can be ascertained.

When an exchange of cards between the main deck region 51 and the side deck region 52 is instructed by the control button 10, the CPU 30 exchanges the card information pertaining to the instructed number of cards between the main deck region 51 and the side deck region 52. The exchange of cards is possible during each battle (which may also be stated as a duel).

Figure 7:
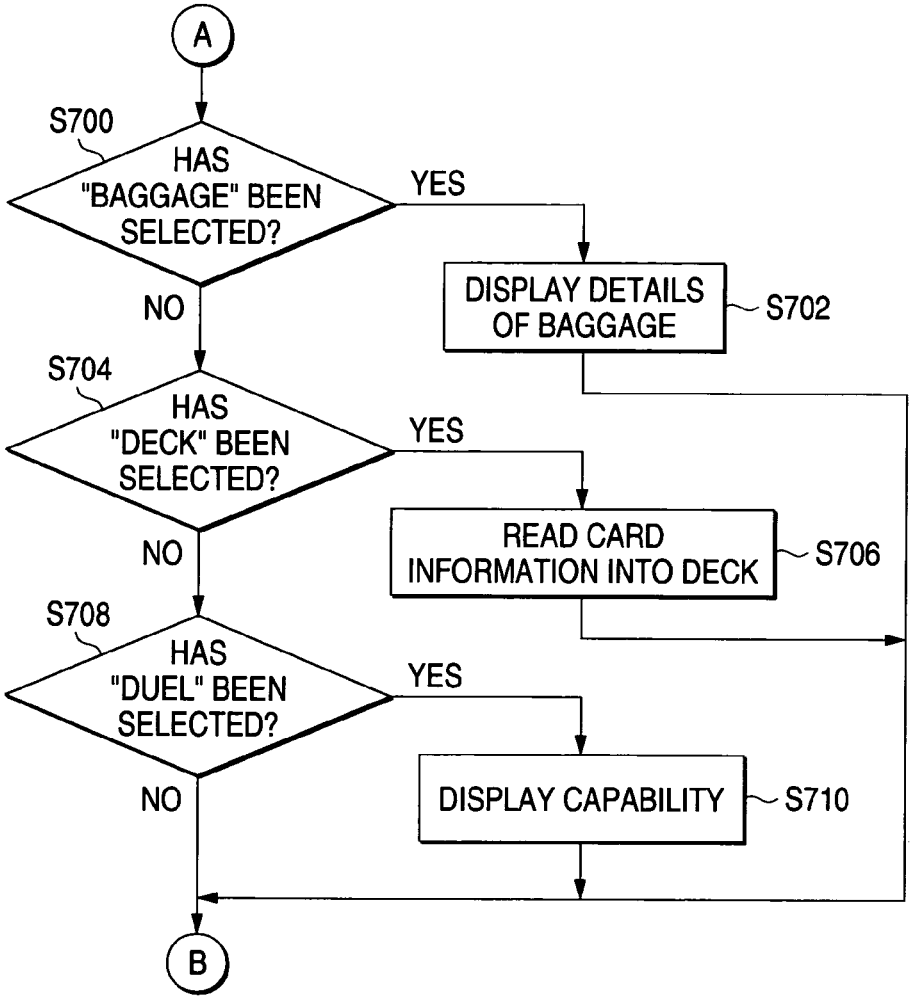
FIG. 7 is a flowchart for explaining the operation of the game machine of the embodiment according to the present invention.

When processing returns to step S708 shown in FIG. 7 and "Duel" is selected by actuation of the control button 10 (YES is selected in step S708), the CPU 30 displays card information items pertaining to respective cards in the display area 21 (step S710). As mentioned above, details on "Baggage" are displayed by actuation of the control button 10, or card information items are stored in the deck area 53, thereby enabling display of detailed information, such as capability of each card.

Next, operations required for playing a real game will be described. After each of a player and an opponent has established a deck, they enter battle.

Figure 9:
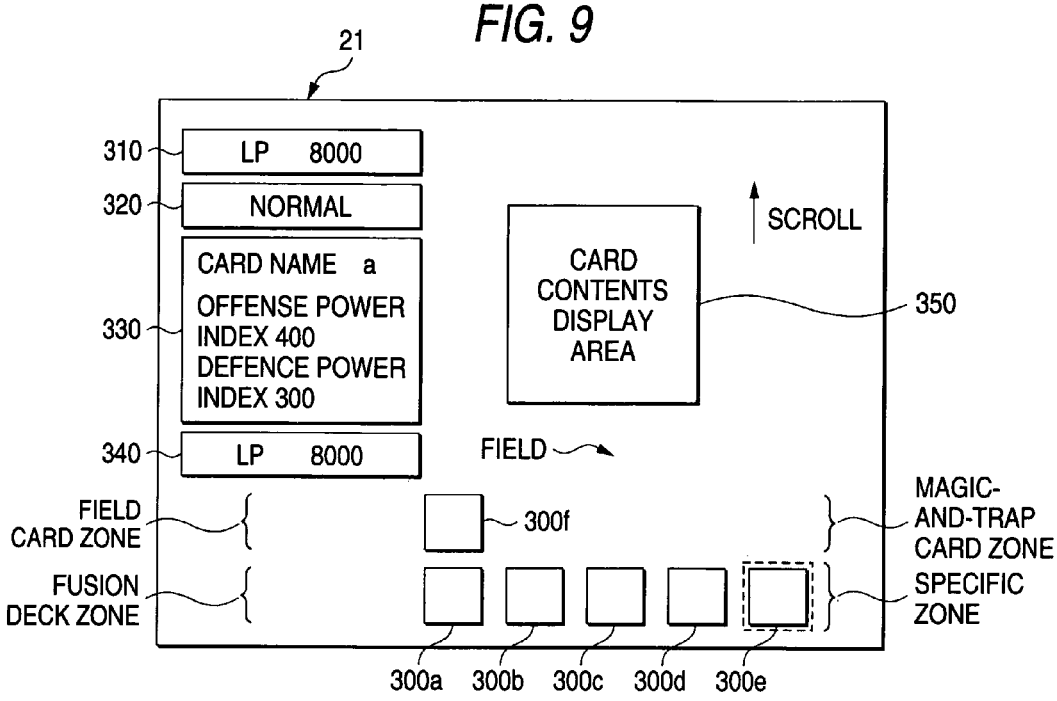
FIG. 9 is a descriptive view showing an example of a display screen appearing in a display area 21 on a display section 20.

When having entered battle, the CPU 30 selects five cards from the player's deck and five cards from the opponent's deck by way of lottery. The thus-selected cards are delivered to a specific zone within the display area 21 while remaining face down (FIG. 9). The thus-delivered cards are called a "hand." The CPU 30 arranges the player's hand into a specific zone located below the display area 21 (i.e., 300*a* through 300*e*) and the opponent's hand into another specific zone located above the display area 21 (not shown) such that the opponent's hand can be seen through scrolling of the display area 21.

In accordance with a player's instruction, the CPU 30 arranges cards which yield special effects, such as magic cards differing from ordinary cards and trap cards, in a magic-and-trap card zone located above the specific zone.

Magic cards are classified into "normal magic cards," which, unless otherwise labeled "Eternal," are essentially to be destroyed after invocation, many of such normal magic cards having great strength; "armament magic cards," which are present eternally while being assigned to a monster; "field magic cards," which continuously affect the overall field after have been laid down until the cards are removed from the field; and "fast-break magic cards," which have a feature of an ordinary magic and a feature of a trap and can be employed from a player's hand during the player's current turn. Further, trap cards are classified into "normal trap cards" which, unless otherwise labeled "Eternal," are destroyed after invocation, and "counter trap cards," which neutralize the effect of a card such as a magic card. Either a magic card or a trap card is laid down in a magic and trap zone designated by 300*f* shown in FIG. 9, thus playing a battle. A field magic card is arranged in a field zone at the left of the display area 21.

When use of a fusion monster card is instructed, the CPU 30 arranges a fusion monster card in a fusion deck zone at the lower left of the display area 21. A fusion monster card can be laid down when a material monster and a magic "fusion" card, which are required for effecting fusion, make a pair in a field or a hand. A fusion monster card can be used in combination with two or more other cards.

The CPU 30 displays a life point total (8,000 points in this embodiment) assigned to the player, in a lower left section (340) within the display area 21. Similarly, a life point total (8,000 points in this embodiment) assigned to the opponent is displayed in an upper left section (310) within the display area 21. The CPU 30 indicates information about a field at that point in a section (320) located at a slightly upper left point within the display area 21 ("normal" in the embodiment shown in FIG. 7).

In this state, the player selects one card from his hand by actuation of the control button 10. The CPU 30 displays the thus-selected card in a conspicuous manner by enclosing the card with dotted lines. Image data pertaining to the selected card are displayed in a center section (a card contents display area 350) of the display area 21. Further, detailed information is displayed in a left center section (330) of the display area 21. The detailed information displayed in the left center section 330 includes a card name and offense and defense power indices.

The embodiment shown in FIG. 9 is intended to represent that the player selects the rightmost card 300*e* from the five cards in his hand. The name of this card is "a," and the card has an offense power index of "400" and a defense power index of "300." The player can ascertain information about his card by actuation of the control button 10 but cannot see any information about the opponent's card.

Figure 10:
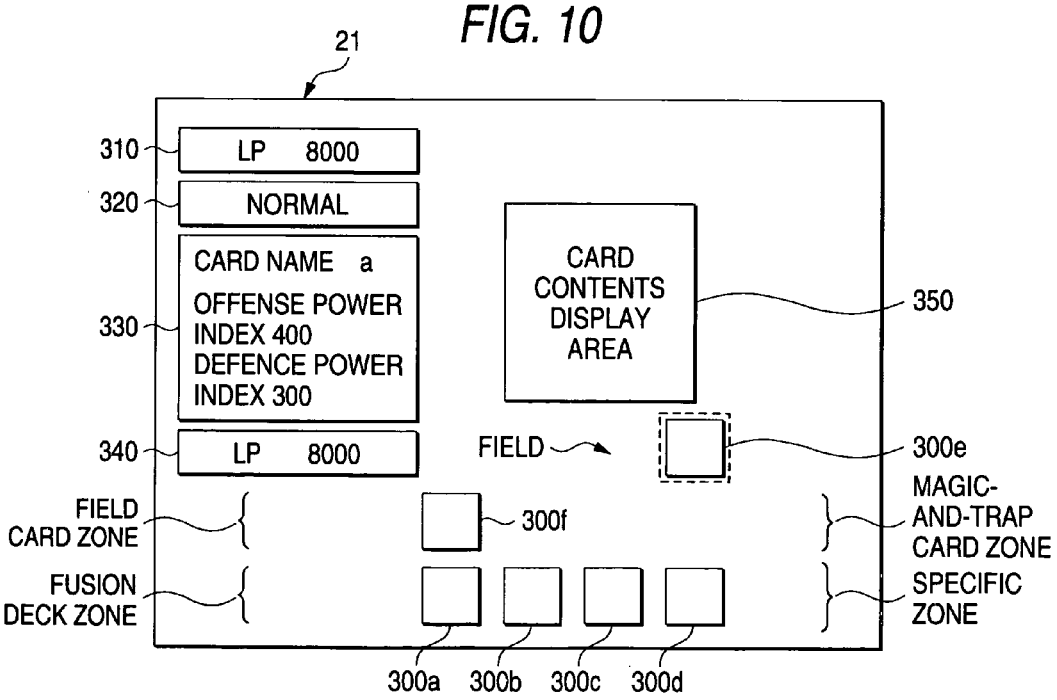
FIG. 10 is a descriptive view showing an example of a display screen appearing in a display area 21 on a display section 20.

As shown in FIG. 10, the card selected through actuation of the control button 10 is instructed to be laid in an area called "Field" located at the center of the display area 21. In response to this instruction, the CPU 30 displays the thus-selected card in the field in a conspicuous manner by enclosing the card with dotted lines. FIG. 10 is a display example where the player has selected and laid the card 300*e* in the field. The CPU 30 displays, in the area 330, detailed information about the card 300*e* laid down in the field, and, in the card contents display area 350, image data pertaining to the card 300*e*. As a matter of course, the opponent cannot see information about the card laid in the field.

Figure 11:
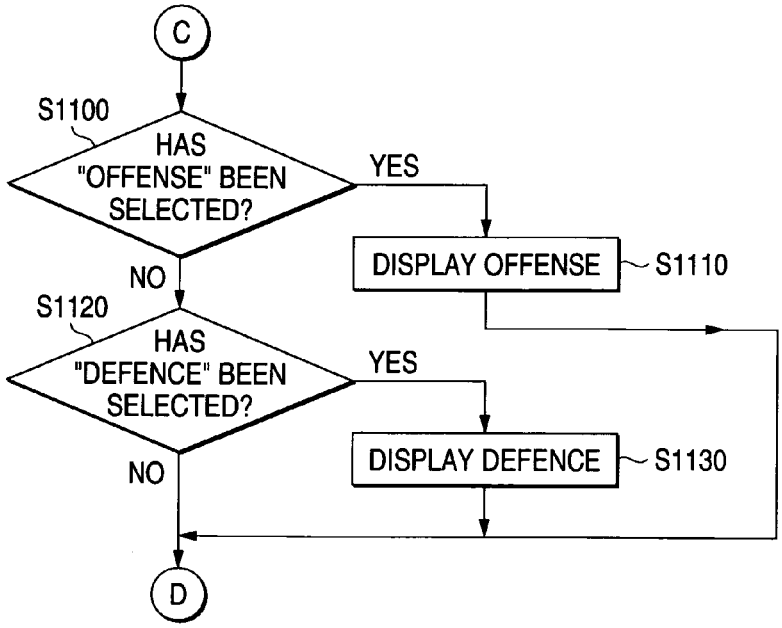
FIG. 11 is a flowchart for explaining the operation of the game machine of the embodiment according to the present invention.
Figure 12:
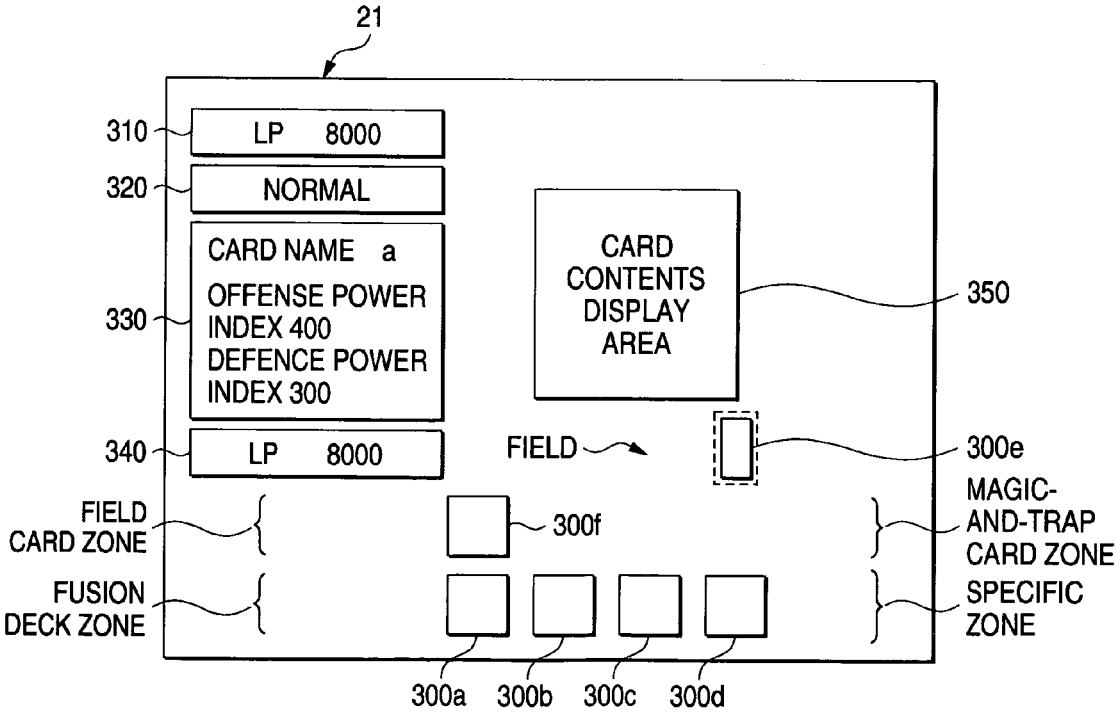
FIG. 12 is a descriptive view showing an example of a display screen appearing in a display area 21 on a display section 20.

When it is determined that "Offense" has been selected in the state shown in FIG. 10 by actuation of the control button 10 (YES is selected in step S1100 shown in FIG. 11), processing proceeds to step S1110, where an offense display is provided. Otherwise (i.e., NO is selected in step S1100), processing proceeds to step S1120. As shown in FIG. 12, the CPU 30 displays the card for which "Offense" has been selected in a vertically-oriented manner in the field, by enclosing the hand with dotted lines so as to make the card conspicuous, thereby effecting an offense display.

Figure 13:
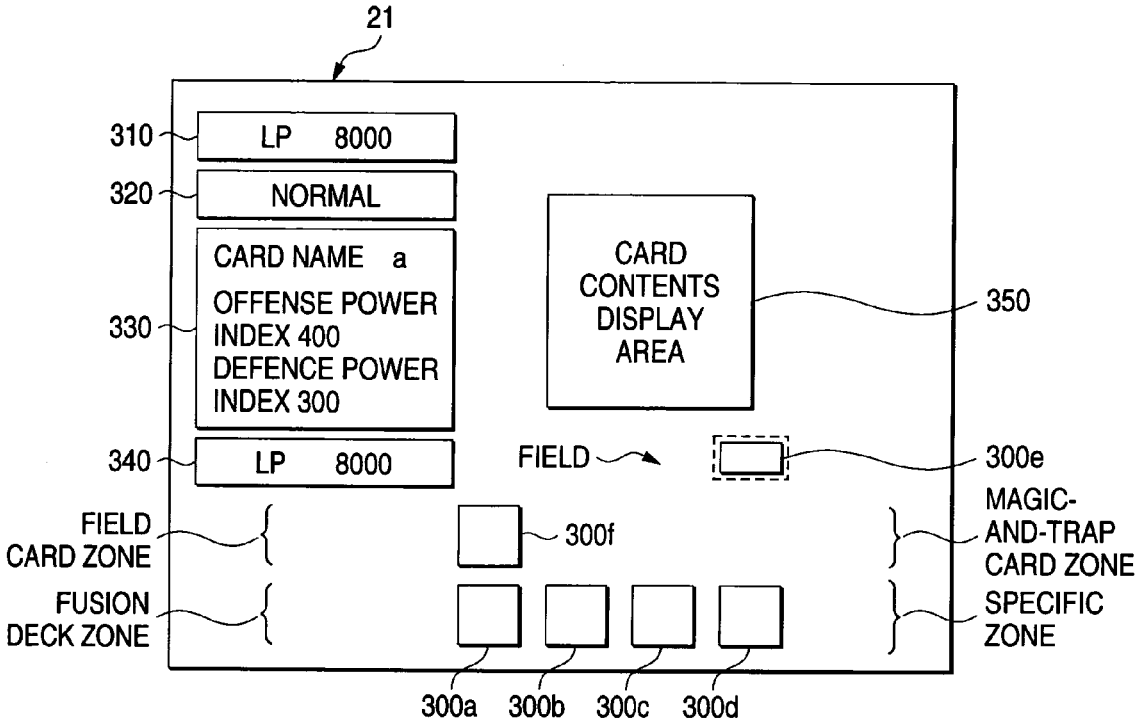
FIG. 13 is a descriptive view showing an example of a display screen appearing in a display area 21 on a display section 20.

In contrast, when it is determined that "Defense" has been selected by actuation of the control button 10 (YES is selected in step S1120), processing proceeds to step S1130, thus effecting a defense display. Otherwise (i.e., when NO is selected in step S1120), processing is terminated. As shown in FIG. 13, the CPU 30 displays the card for which "Defense" has been selected, in a horizontally-oriented manner in the field, by enclosing the card with dotted lines so as to make the card conspicuous, thereby effecting an offense display.

In the statuses shown in FIGS. 12 and 13, only one card is laid in the field. There may be a case where a plurality of cards or no cards are laid in the field. For example, if the player or the opponent continues selecting only "Defense, " the number of cards displayed in the field increases continuously. Alternatively, even when either of the player and the opponent continuously scores wins, the number of cards laid in the field increases. In any event, when one or more cards are displayed in the field, the player can select either "Offense" or "Defense" for each of the cards.

Figure 14:
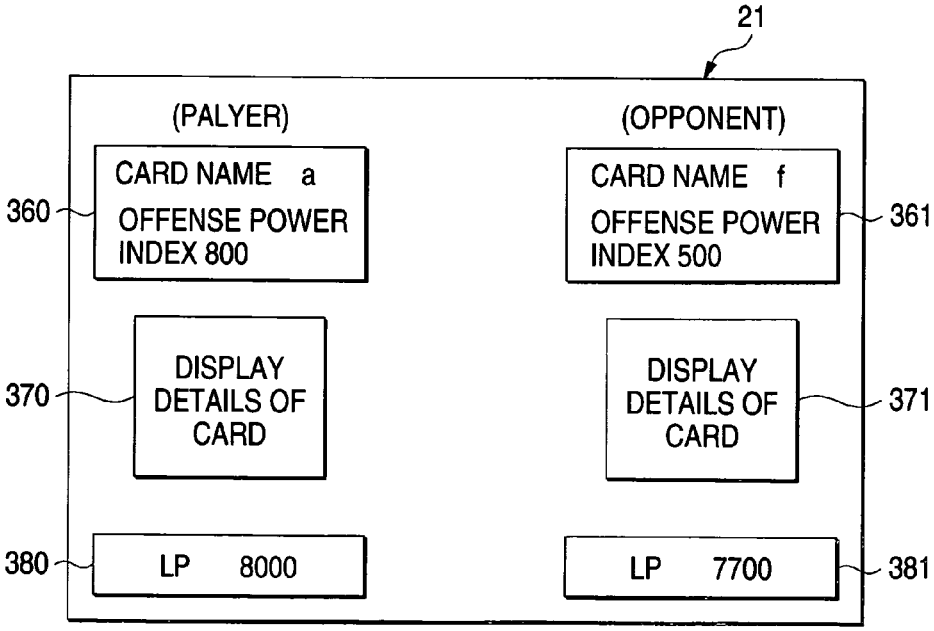
FIG. 14 is a descriptive view showing an example of a display screen appearing in a display area 21 on a display section 20.

If the opponent also lays a card in the field in the statuses shown in FIGS. 12 and 13 and if either the player or the opponent selects "Offense," the CPU 30 displays the name and power index of the player's card in an area 360 and the name and power index of the opponent's card in an area 361, as shown in FIG. 14. The image data pertaining to the cards are displayed in areas 370 and 371, respectively. Further, life points assigned to the player are displayed in an area 380, and life points assigned to the opponent are displayed in an area 381, thus causing the player and the opponent to enter battle. A winner and a loser are determined in accordance with the power indices. After completion of the battle, the CPU 30 provides a display shown in FIG. 12, thereby leaving the winner's card remaining in the field face up. In contrast, the loser's card is caused to disappear from the display area 21. An object of offense can be arbitrarily selected from the cards arranged in the field of the other.

After completion of one battle, the CPU 30 replenishes a hand by selection of cards from the main deck region 51 such that five cards become available. Through continuous execution of these operations, the CPU 30 displays the player who has lost all his life points as a loser and the remaining player as a winner (not shown).

Figure 15:
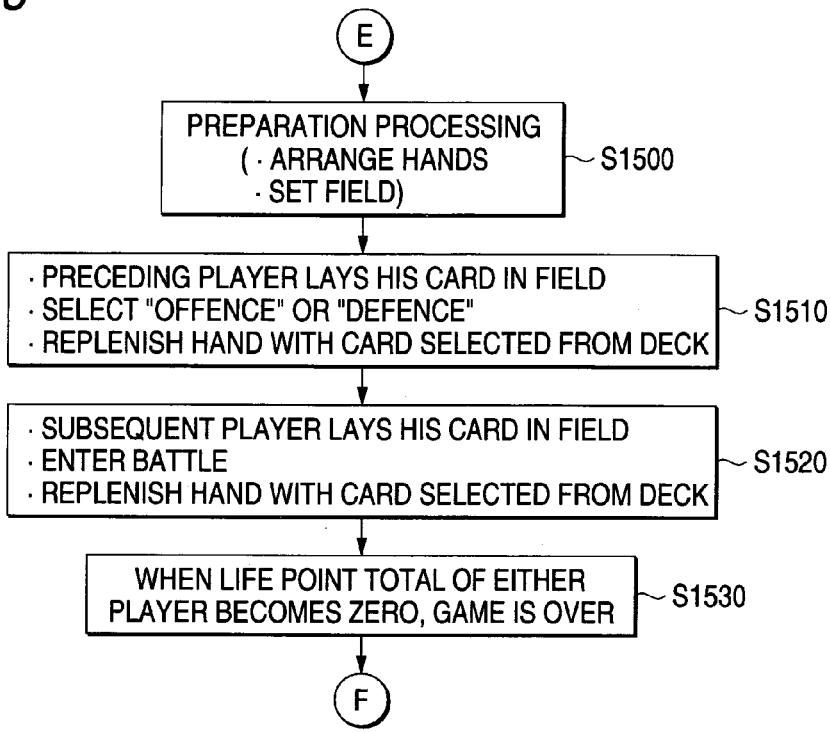
FIG. 15 is a flowchart for explaining the operation of the game machine of the embodiment according to the present invention.

The game of this type is explained in more detail with reference to a flowchart. The following description is given on the assumption that the player plays a game against a game machine (also called an "opponent") and that each side has completed establishment of a deck. The CPU 30 arbitrary selects five cards from the main deck region 51 of the player and from the main deck region 51 of the opponent. Further, a field is determined by lottery (step S1500 shown in FIG. 15).

After having determined either the player or the opponent as one who makes the first move in a game (a preceding player) and the remaining as one who makes the second move (a subsequent player), the preceding player lays one card from his hand in the field. The preceding player selects either "Offense" or "Defense" in connection with the thus-selected card. Moreover, when "Offense" has been selected, the CPU 30 displays the card in a vertically-oriented manner as shown in FIG. 12. When "Defense" has been selected, the CPU 30 displays the card in a horizontally-oriented manner as shown in FIG. 13. Since the preceding player has laid one card in the field, the hand of the preceding player is replenished with a card selected from the main deck region 51 such that five cards are available (step S1510).

As in the case of the preceding player, the subsequent player lays one card from his hand into the field. Now, a battle between the preceding and subsequent players is commenced. After completion of the battle, the hand of the subsequent player is replenished with a card selected from the main deck region 51 such that five cards are available (step S1520). As described in connection with step S1530, the battle is continued until one of the players loses all his life points (i.e., has a life point total of 0).

Figure 16:
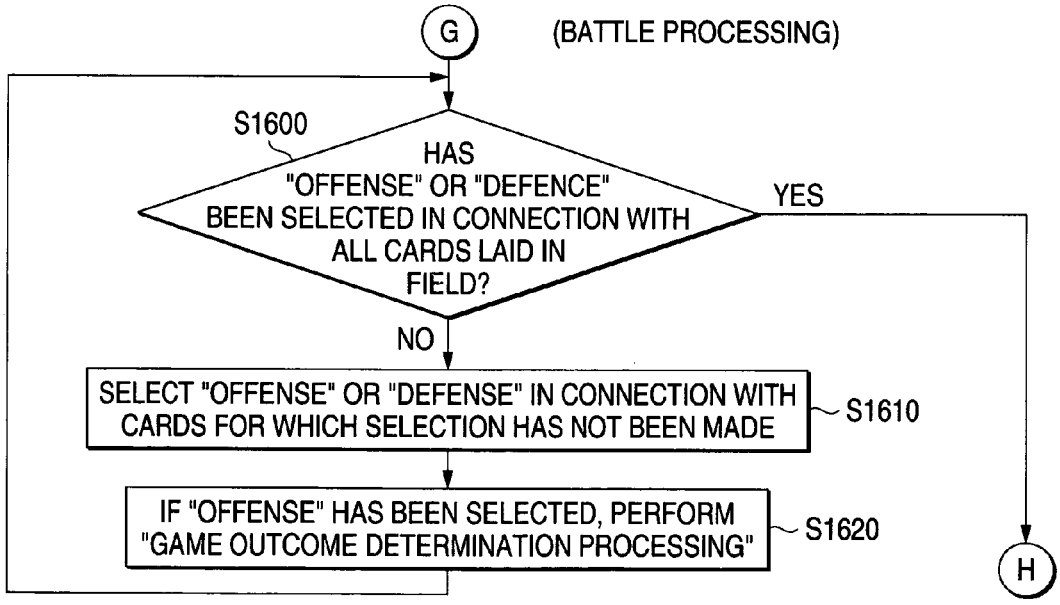
FIG. 16 is a flowchart for explaining the operation of the game machine of the embodiment according to the present invention.

The battle pertaining to step S1520 is processed in such a manner as shown in FIG. 16. When "Offense" or "Defense" has been selected for all the cards laid in the field in step S1600 (YES is selected in step S1600), the CPU 30 terminates processing. Processing returns to step S1520, and cards are alternately laid down in the field. Otherwise, processing proceeds to step S1610.

Next, either "Offense" or "Defense" is selected in connection with a card of the preceding or subsequent player (step S1610). When "Offense" is selected, the CPU 30 determines a winner and a loser (step S1620). When neither side has selected "Offense," processing proceeds to step S1600. When "Offense" or "Defense" has been selected in connection with all the cards laid in the field (YES is selected in step S1600), a battle is over.

FIG. 17 is a table for describing determination of a winner and a loser performed by the CPU 30. If "Offense" and "Offense" have been selected, the number of life points equal to a difference between the offense power indices of both cards is subtracted from the life point total of the loser, and the loser's card is caused to disappear from the display area 21. In the case of "Offense" and "Defense" having been selected, if "Offense" has won the battle (i.e., the offense power index exceeds the defense power index), the loser's card is caused to disappear from the display area 21. In contrast, if "Defense" has won the battle (i.e., the defense power index exceeds the offense power index), the number of life points equal to a difference between the power indices of both cards is subtracted from the life point total of the loser. If "Attack" and "No card in field" have been selected, the number of life points corresponding to the offense power index are subtracted from the life point total of the player who has laid no card in the field.

When one of the players has lost all his life points (i.e., has a life point total of 0) after having continued battles in the manner as mentioned above, the player is determined to be a loser, and the other player is determined to be a winner. Thus, a round of card games is completed. Such a winner and a loser are determined through a battle in which three battles are fought. A player who has two wins and one loss or one win and two draws is determined to be a winner. A draw arises when life point totals of both players become zero concurrently.

3. Principal Feature of the Present Invention

The principal feature of the present invention will next be described. In the present embodiment, as shown in FIG. 18, the CPU 30 causes a plurality of opposing characters to appear on the field in each of first through fourth stages. In a first stage, five types of duelists; i.e., duelists 1 through 5, appear and play a battle in the first stage. Opposing characters can be selected in an arbitrary sequence by actuation of the control buttons 10.

4. Operation Example 1

Figure 19:
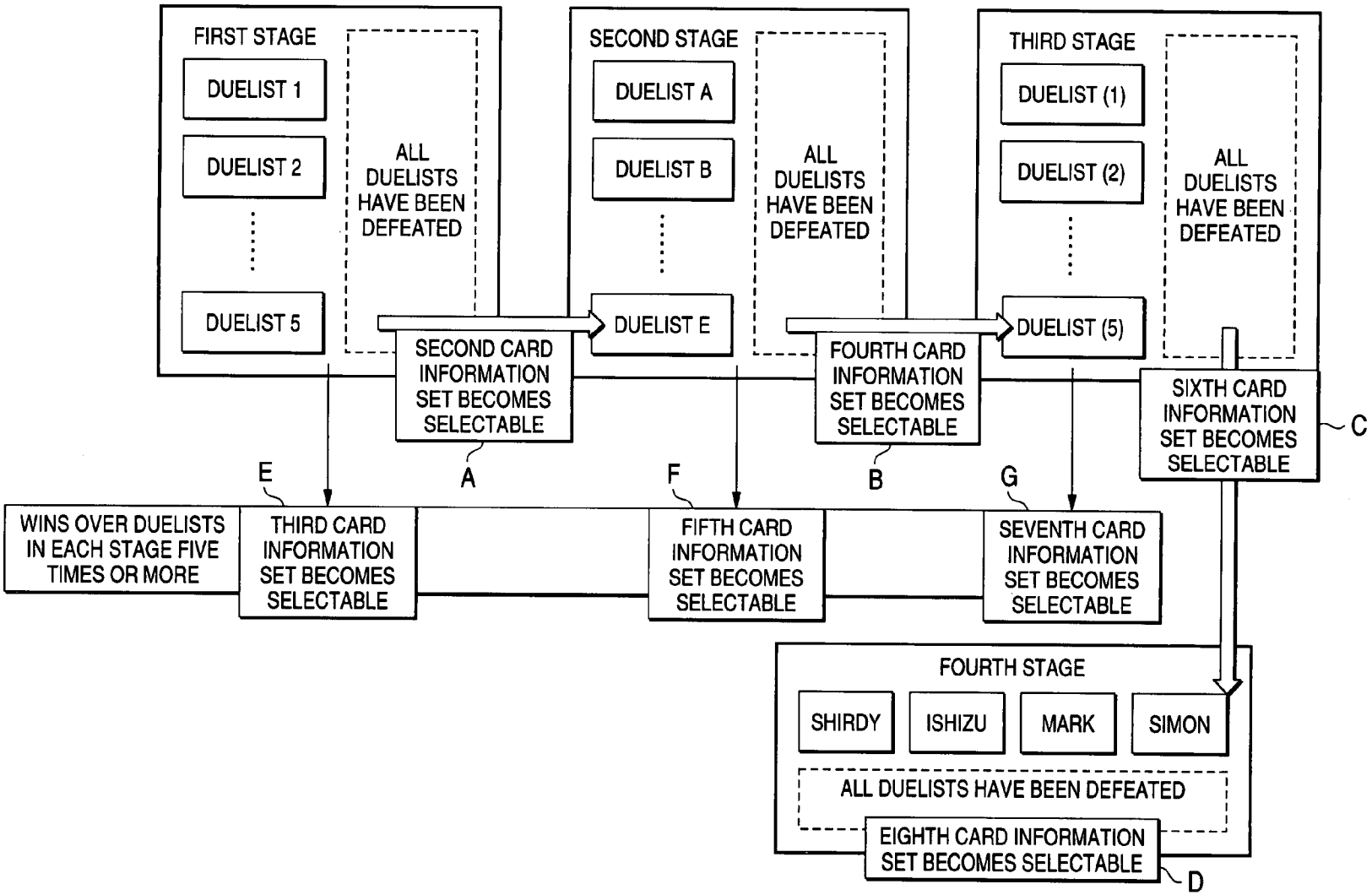
FIG. 19 is a descriptive view for explaining the principal part of the present invention.
Figure 20:
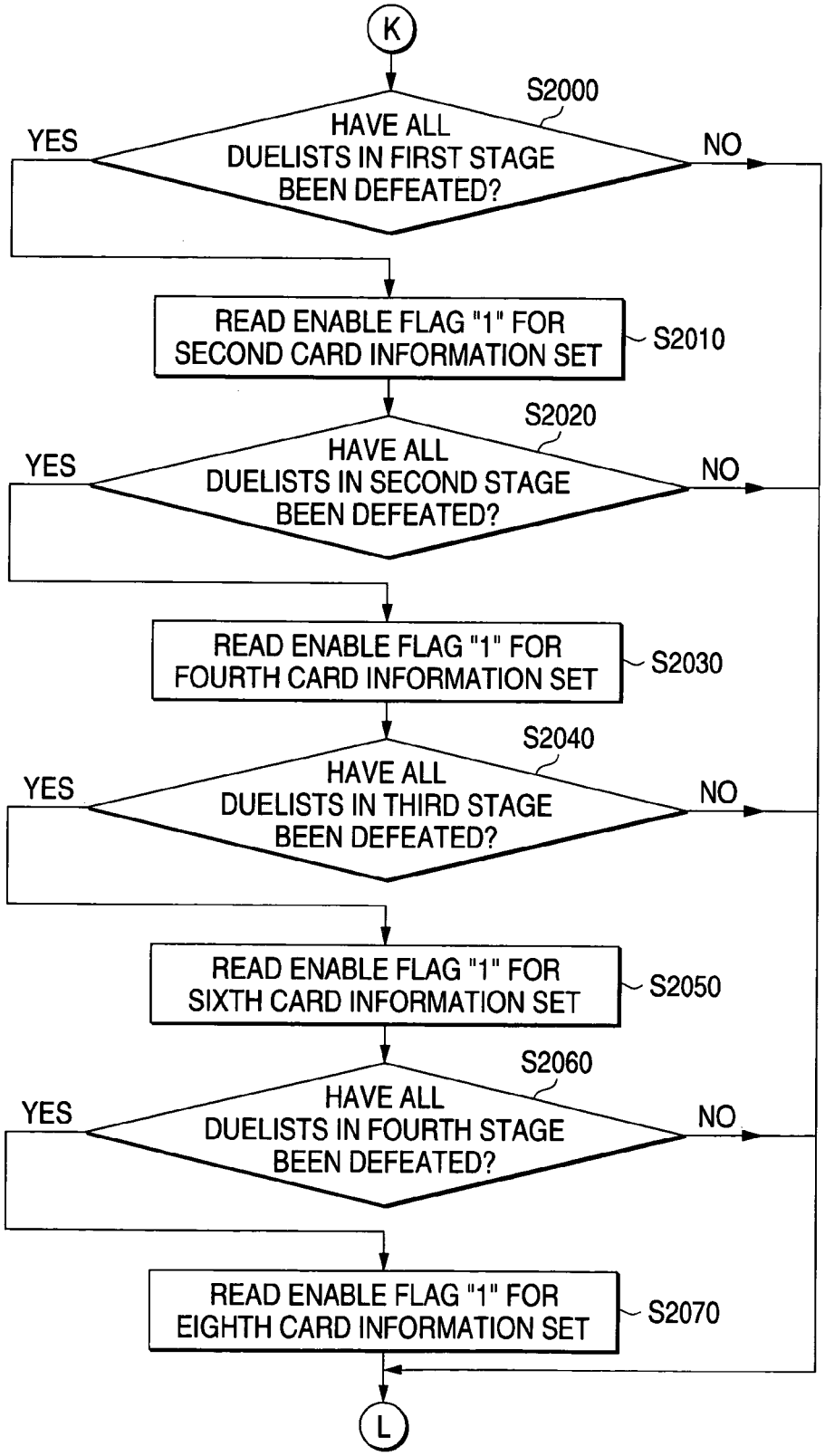
FIG. 20 is a flowchart for explaining the operation of the principal section of a game machine of the embodiment according to the present invention.

When the player has won over all the duelists in the first stage after having played a battle with duelists 1 through 5, the CPU 30 causes the player to proceed to a second stage (when YES is selected in step S2000 shown in FIG. 20). As indicated in step S2010 shown in FIG. 20, a read enable flag corresponding to the second card information set in the card information table shown in FIG. 2 is switched from 0 to 1. Consequently, as indicated by reference symbol A shown in FIG. 19, the player can read card information items also from the second card information set. Hence, the CPU 30 stores a larger number of cards into the baggage area 54. The cards are made available in the deck area 53, thus increasing the number of cards available in a battle.

When the player has won over all the duelists in the second stage after having played a battle with duelists A through E, the CPU 30 causes the player to proceed to a third stage (when YES is selected in step S2020 shown in FIG. 20). At this time, as indicated by step S2030 shown in FIG. 20, a read enable flag corresponding to the fourth card information set in the card information table shown in FIG. 2 is switched from 0 to 1. As a result, as indicated by reference symbol B shown in FIG. 19, card information items can be read also from the fourth card information set. Consequently, the CPU 30 stores a much larger number of cards into the baggage area 54. The cards are made available in the deck region 53, thus increasing the number of cards available in a battle.

Next, when the player has won over all the duelists in the third stage having played a battle with duelists (1) through (5), the CPU 30 causes the player to proceed to the fourth stage (when YES is selected in step S2040 shown in FIG. 20). At this time, as indicated in step S2050 shown in FIG. 20, a read enable flag corresponding to the sixth card information set in the card information table shown in FIG. 2 is switched from 0 to 1. Consequently, as indicated by reference symbol C shown in FIG. 10, card information items can be read from the sixth card information set. Consequently, the CPU 30 stores a larger number of cards into the baggage area 54. The cards are available in the deck area 53, and the number of cards available in a battle is increased.

When the player has won over all the duelists in the fourth stage after having played a battle with duelists "SHIRDY," "ISHIZU," "MARK," and "SIMON" (when YES is selected in step S2060 shown in FIG. 20), a read enable flag corresponding to the eighth card information set in the card information table shown in FIG. 2 is switched from 0 to 1, as indicated by step S2070 shown in FIG. 20. Consequently, as indicated by reference symbol D shown in FIG. 19, card information items can be read also from the sixth card information set. Thus, the CPU 30 stores a much greater number of cards in the baggage area 54, and the cards are made available in the deck area 53, thus increasing the number of cards available in a battle.

According to operation example 1, a plurality of stages are set, wherein a plurality of opposing characters which become opponents in a battle appear. When a player has won over opposing characters in a certain stage, the player proceeds to the next stage, and the number of cards which the player can use in a battle is increased. Thus, the player can increase the number of cards available in a battle while enjoying a game.

5. Operation Example 2

Next, operation example 2 will be described. Five types of opposing characters; i.e., duelists 1 through 5, appear in the first stage. Opposing characters can be selected in an arbitrary sequence by actuation of the control button 10.

Figure 21:
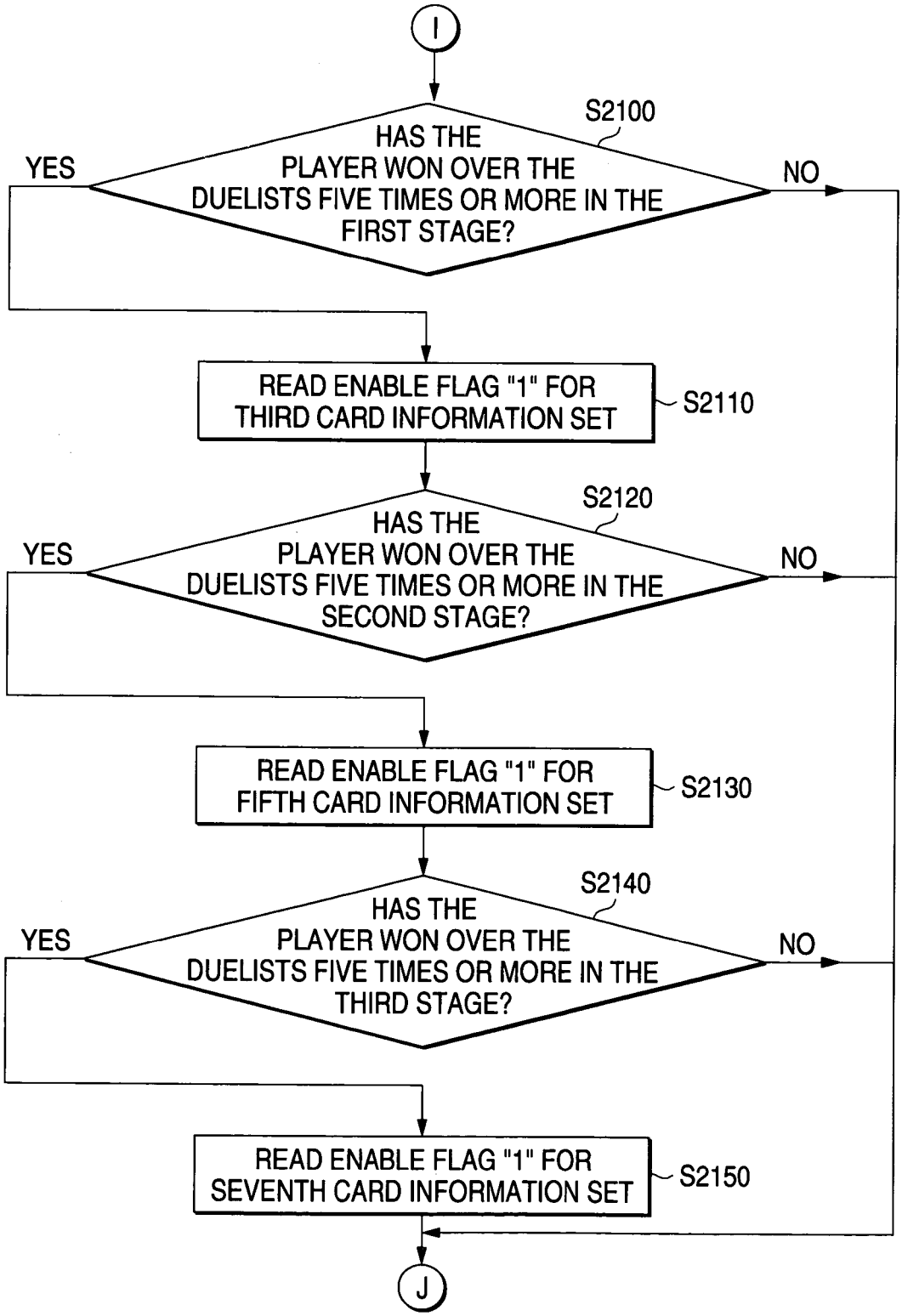
FIG. 21 is a flowchart for explaining the operation of the principal section of a game machine of the embodiment according to the present invention.

When having won five times over the duelists after having played a battle with all the duelists 1 through 5 in the first stage (when YES is selected in step S2100 shown in FIG. 21), the read enable flag corresponding to the first card information set in the card information table shown in FIG. 2 is switched from 0 to 1, as indicated by step S2110. Therefore, as indicated by reference symbol E shown in FIG. 109, card information items can be read from the third card information set. Consequently, the CPU 30 stores a greater number of cards into the baggage area 54, and the cards are made available in the deck area 53, thus increasing the number of cards available in a battle.

When the player has won five times or more over all the duelists in the second stage after having played a battle with duelists A through E (when YES is selected in step S2120 shown in FIG. 21), a read enable flag corresponding to the fifth card information set in the card information table shown in FIG. 2 is switched from 0 to 1, as indicated by step S2130. As a result, as indicated by reference symbol F shown in FIG. 19, card information items can be read also from the fifth card information set. Consequently, the CPU 30 stores a much larger number of cards into the baggage area 54. The cards are made available in the deck region 53, thus increasing the number of cards available in a battle.

When the player has won five times or more over all the duelists in the third stage after having played a battle with duelists (1) through (5) (when YES is selected in step S2140 shown in FIG. 21), a read enable flag corresponding to the seventh card information set in the card information table shown in FIG. 2 is switched from 0 to 1, as indicated by step S2150. As a result, as indicated by reference symbol G shown in FIG. 19, card information items can be read also from the seventh card information set. Consequently, the CPU 30 stores a much larger number of cards into the baggage area 54. The cards are made available in the deck region 53, thus increasing the number of cards available in a battle.

In operation example 2, a plurality of stages are set, wherein a plurality of opposing characters which are to become opponents in a battle become able to appear. When the player has won over the opposing characters a predetermined number of times in a certain stage, the number of cards which can be used by the player in a battle is increased. Thus, the player can increase the number of cards available in a battle while enjoying a game.

The CPU 30 enables loading of a plurality of card information sets, which are information items pertaining to a plurality of cards recorded in a card information table 220 stored in the cassette 200, on a per-unit-card-information-set basis. Thus, the number of cards which the player can use in a battle is increased, and a read enable flag is set for a card information set for which loading has been allowed. Loading of a card information set and enabling of reading operation can be performed readily.

If a plurality of card information sets are set such that contents of the information sets differ from each other, the entertainment value of a card game is increased correspondingly. Further, the cassette 200 (recording medium) is embodied in the form of an external recording medium removably attached to a game machine. Hence, storage of card information is easy. If a read enable flag setting area is formed in the external recording medium, formation of a read enable flat setting region becomes easy.

The CPU 30 performs the operation described in connection with operation example 1 and the operation described in connection with operation example 2. The CPU 30 sets a plurality of stages in which a plurality of opposing characters which are to become opponents in a battle become able to appear. When the player has won over the opposing characters in a certain stage, the CPU 30 causes the player to proceed to the next stage, thereby increasing the number of cards which the player can use in a battle. Alternatively, there may be set a plurality of stages in which a plurality of opposing characters become opponents in a battle. When the player has won over the opposing characters at least a predetermined number of times in a certain stage, the number of cards which the player can use in a battle may be increased.

6. Additional Embodiment

In the present embodiment, an event table 230 shown in FIG. 22 is stored in the cassette 200. Dates of occurrence of events, event items, details of events, opposing characters, and fields to be set are stored in the event table 230 so as to become associated with each other.

Figure 23:
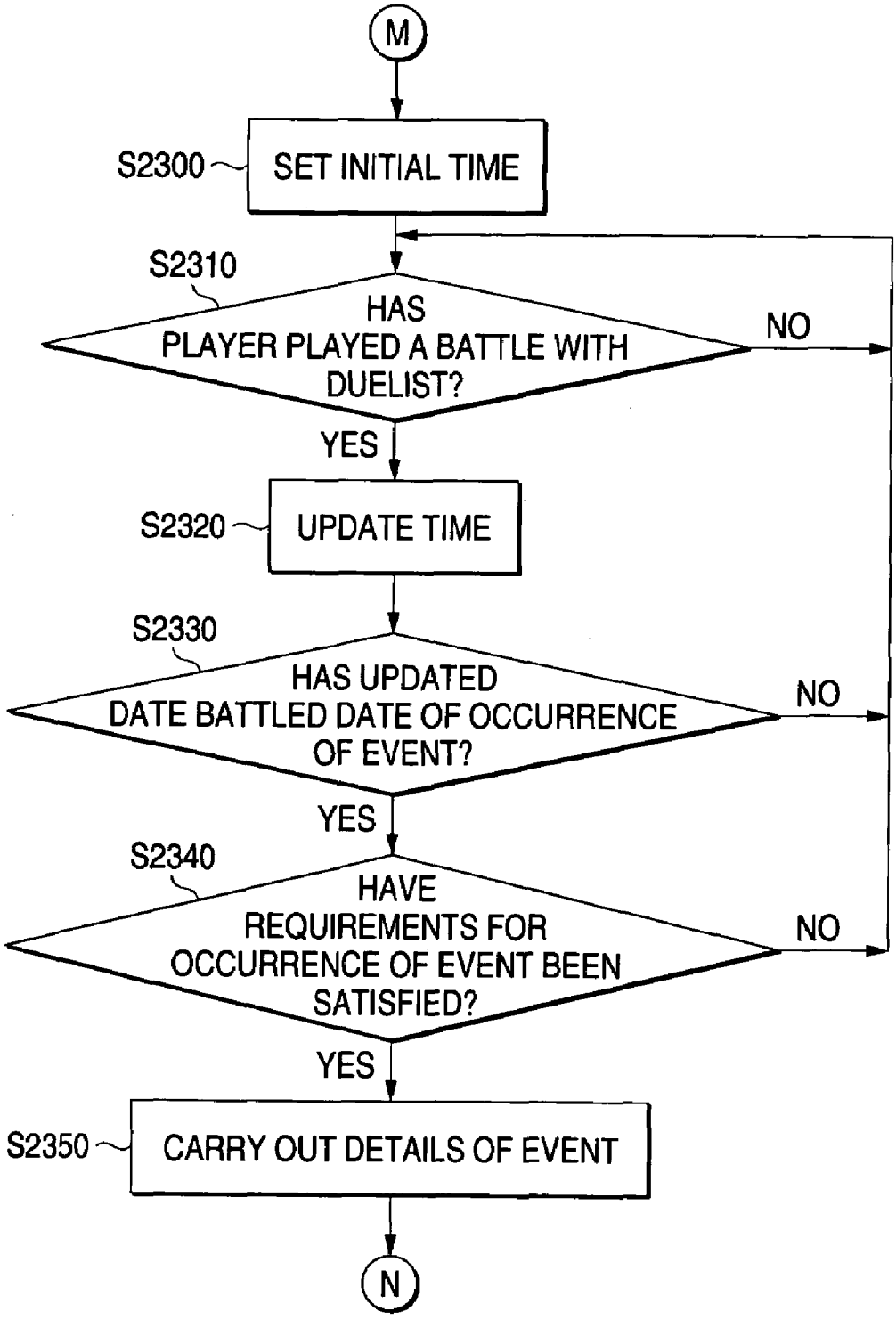
FIG. 23 is a flowchart for explaining the operation of a game machine of another embodiment according to the present invention.

As shown in FIG. 23, the CPU 30 sets January 1$^{st}$ as an initial date and time (step S2300). When the player has played a battle with a duelist (when YES is selected in step S2310), the CPU 30 causes processing to proceed to step S2320. Otherwise (when NO is selected in step S2310), the CPU 30 enters a wait mode in step S2310.

In step S2320, the CPU 30 updates a date and time. Updating of a date and time means updating of a date and time in the world of a game. Every time a battle with a duelist is performed, the date and time are advanced only one day. In step S2330 the thus-updated time and date are stored in the event table 230. If the updated time and date correspond to a date of occurrence of any event (when YES is selected in step S2330), processing proceeds to step S2340. Otherwise, processing returns to step S2310. If the updated time and date are September 15, the date and time are handled as a date of occurrence of an event; that is, Respect-for-the-Aged Day.

In step S2340, the CPU 30 makes a determination as to whether or not the CPU 30 has satisfied requirements for occurrence of an event. If requirement for occurrence of an event are satisfied, processing proceeds to step S2350, and details of the event are executed. Otherwise, processing returns to step S2310.

If an updated date and time is September 15, the date corresponds to a date of occurrence of an event as Respect-for-the-Aged Day. The event represents that "You get a card if you win a game." If the player has played a battle with Pandora in field "Darkness" and won over Pandora, the player can acquire a card. The thus-acquired card is added to the baggage area 54 by the CPU 30. Thus, the player can increase card available in a battle while enjoying a game.

In the present embodiment, the CPU 30 updates information about a date and time in the world of a game every time the player plays a battle with an opposing character. When the thus-updated date and time battle a predetermined date of occurrence of an event, an event is performed if requirements for occurrence of the event are satisfied. Further, if the player's winning over an opposing character is a requirement for occurrence of an event, when the player has won over the opposing character, the player acquires a new card available in a battle. Thus, the entertainment of a game is increased further.

As has been described, according to the present embodiment, the CPU 30 increases the number of cards available in a battle as the player continues winning. Thus, the player can increase the number of cards available in a battle while enjoying a game. The embodiments are susceptible to variations or alterations within the scope of the invention. For example, any card information items may be added to the card information sets shown in FIG. 5, or contents of events may be changed to contents other than those shown in FIG. 22.

As described above, according to the present invention, the number of cards available in a battle is increased as the player continues winning. Thus, there is yielded an advantage of the player being able to increase the number of cards available in a battle while enjoying a game.

It is contemplated that numerous modifications may be made to the game machine, the method of controlling the operation of the game machine, and the recording medium, such as a computer readable medium, having recorded thereon an operation control program for controlling the game machine, of the present invention without departing from the spirit and scope of the invention as defined in the following claims.

What is claimed is:

1. A game machine which enables a player and an opponent to play a battle by laying down their cards in a game screen, the game machine comprising:

a control device which increases the number of cards available in a battle when the player continues winning, wherein the control device updates time information pertaining to the world of a game every time the player plays a battle with an opposing character, and wherein the control device effects contents of an event when requirements for occurrence of an event are satisfied if the updated time corresponds to a predetermined date and time at which an event is to arise.

2. The game machine of claim 1, wherein the control device causes the player to acquire a new card available in a battle when the player has won over an opposing character, when the player's winning over an opposing character is defined as a requirement for occurrence of an event.

3. The game machine of claim 1, wherein the control device sets a plurality of stages in which a plurality of opposing characters which are opponents in a battle are able to appear, causes the player to advance to a next stage after having won over respective opposing characters in a certain stage, and increases the number of cards available in a battle.

4. The game machine of claim 1, wherein the control device sets a plurality of stages in which a plurality of opposing characters which are opponents in a battle are able to appear, and increases the number of cards available in a battle when the player has won over the opposing characters at least a predetermined number of times in a certain stage.

5. The game machine of claim 1, wherein the control device enables loading of, on a per-unit-card-information-set basis, a plurality of card information sets pertaining to a plurality of cards recorded on a computer readable medium, thereby enabling the player to increase the number of cards available in a battle.

6. The game machine of claim 5, wherein the control device sets a read enable flag for a card information set for which loading has been permitted.

7. The game machine of claim 5, wherein the plurality of card information sets are set so as to differ from each other.

8. The game machine of claim 6, wherein the plurality of card information sets are set so as to differ from each other.

9. The game machine of claim 5, wherein the computer readable medium includes an external computer readable medium removably aft ached to the game machine, and a setting region for the read enable flag is formed on the external computer readable medium.

10. The game machine of claim 6, wherein the computer readable medium includes an external computer readable medium removably attached to the game machine, and a setting region for the read enable flag is formed on the external computer readable medium.

11. A method of controlling operation of a game machine which enables a player and an opponent to play a battle by laying down their cards, the method comprising the steps of:

setting a plurality of stages in which a plurality of opposing characters which are opponents in a battle are able to appear; and causing the player to proceed to the next stage when having won over the opposing characters in a certain stage, thereby increasing the number of cards available in a battle, farther comprising the steps of:

updating time information pertaining to the world of a game every time the player plays a battle with an opposing character; and effecting details of an event when requirements for occurrence of an event have been satisfied if the updated date and time corresponds to a predetermined date and time at which a certain event is to arise.

12. A method of controlling operation of a game machine which enables a player and an opponent to play a battle by laying down their cards, the method comprising the steps of:

setting a plurality of stages in which a plurality of opposing characters which are opponents in a battle are able to appear; and increasing the number of card available in a battle when the player has won over the opposing characters at least a predetermined number of times in a certain stage, and further comprising the steps of:

updating time information pertaining to the world of a game every time the player plays a battle with an opposing character; and effecting details of an event when requirements for occurrence of an event have been satisfied if the updated date and time corresponds to a predetermined date and time at which a certain event is to arise.

13. A computer readable medium having recorded thereon an operation control program for controlling operation of a game machine which enables a player and an opponent to play a battle by laying down their cards, the operation control program comprising:

a processing routine for increasing the number of cards available in a battle when the player continues winning, and wherein the processing routine includes:

updating time information pertaining to the world of a game every time the player plays a battle with an opposing character, and effecting details of an event when requirements for occurrence of an event have been satisfied if the updated date and time corresponds to a predetermined date and time at which a certain event is to arise.

14. The computer readable medium of claim 13 wherein the processing routine includes:

setting a plurality of stages in which a plurality of opposing characters which are opponents in a battle are able to appear, and causing the player to proceed to the next stage when having won over the opposing characters in a certain stage, thereby increasing the number of cards available in a battle.

15. The computer readable medium of claim 13 wherein the processing routine includes:

setting a plurality of stages in which a plurality of opposing characters which are opponents in a battle are able to appear, and increasing the number of cards available in a battle when the player has won over the opposing characters at least a predetermined number of times in a certain stage.

16. A game machine, comprising:

display, which displays a game enabling a player and an opponent to play a battle by laying down their cards;

an exchangeable storage, in which a plurality of card information groups are stored in advance, each of card information groups being associated with one of a plurality of stages in the game, and including:

a plurality of card information items; and a flag, having a first state which disables reading out of associated one of the card information groups from the storage, and a second state which enables the reading out;

a random access memory, and a controller, which places the flag in one of the card information groups, which is associated with one of the plural stages that the player has cleared, in the second state, and loads the one of the card information groups that the flag has been placed in the state to the random access memory.

17. A game machine, comprising:

a display, which displays a game enabling a player and an opponent to play a battle by laying down their cards;

an exchangeable storage, in which a plurality of card information groups are stored in advance, each of the card information groups being associated with one of a plurality of stages in the game, and including:

a plurality of card information items; and a flag, having a first state which disables reading out of associated one of the card information groups from the storage, and a second state which enables the reading out;

a random access memory; and a controller, which places, in the second state, the flag in one of the card information groups, which is associated with one of the stages when the player wins over at least one opponent character present in the one of the stages a predetermined number of times, and loads the one of the card information groups that the flag has been placed in the second state of the random access memory.

* * * * *